US006792910B2

(12) United States Patent
Haman et al.

(10) Patent No.: US 6,792,910 B2
(45) Date of Patent: Sep. 21, 2004

(54) OIL INJECTION SYSTEM

(75) Inventors: David Haman, Stuart, FL (US); Richard P. Kolb, Prairieview, IL (US)

(73) Assignee: Bombardier Recreational Products Inc., Saint-Bruno (CA)

( * ) Notice: Subject to any disclaimer, the term of this patent is extended or adjusted under 35 U.S.C. 154(b) by 0 days.

(21) Appl. No.: 10/268,383

(22) Filed: Oct. 10, 2002

(65) Prior Publication Data

US 2003/0029396 A1 Feb. 13, 2003

Related U.S. Application Data

(62) Division of application No. 09/267,481, filed on Mar. 11, 1999, now abandoned.

(51) Int. Cl.[7] ..... F01M 1/00
(52) U.S. Cl. ..... 123/196 R; 123/73 C
(58) Field of Search ..... 123/196 R, 196 M, 123/73 C, 193.2, 73 A, 73 AD

(56) References Cited

U.S. PATENT DOCUMENTS 3,021,183 A * 2/1962 Cheney et al. ..... 123/73 A
5,513,608 A * 5/1996 Takashima et al. .... 123/196 W
5,806,631 A * 9/1998 Yoshida et al. ..... 123/196 R
6,032,638 A * 3/2000 Kato ..... 123/73 C

FOREIGN PATENT DOCUMENTS

WO WO 95/08058 * 3/1955

* cited by examiner

*Primary Examiner*—Noah P. Kamen
(74) *Attorney, Agent, or Firm*—BRP Legal Services

(57) ABSTRACT

A cylinder block assembly for an internal combustion engine having a cylinder block and a plurality of cylinders includes an oil port in each of the cylinders. An annular groove is located in each cylinder wall so that oil flowing from the oil port flows into the annular groove to lubricate the skirt of the piston. An opening may be located in the piston so that oil flowing from the oil port flows into and through the piston opening when the piston is at a predetermined position, thereby directly injecting oil into the piston to lubricate the wrist pin of the piston.

17 Claims, 2 Drawing Sheets

OIL INJECTION SYSTEM

CROSS REFERENCE TO RELATED APPLICATION

This application is a divisional application and claims priority of U.S. application Ser. No. 09/267,481, filed Mar. 11, 1999 now abandoned.

BACKGROUND OF THE INVENTION

The invention relates generally to outboard engines, and more particularly, to the oil injection systems for two-stroke internal combustion engines.

Known v-type internal combustion engines for marine use include a cylinder block having a crankcase and two banks of cylinders extend radially from the crankcase. In a six cylinder engine, for example, each cylinder bank includes three cylinders. Each cylinder includes a sleeve and a piston moves relative to the sleeve between top dead center and bottom dead center positions. A main exhaust passageway and cooling water passageway are located between the first and second cylinder banks.

In operation, the friction between the pistons and the sleeves can result in generation of heat and wear of both the pistons and the sleeves. To reduce such heat generation and wear, oil should be dispersed between the pistons and the sleeves. The clearance between the pistons and the sleeves, however, is only about 0.004 to 0.010 inches. Dispersing oil between the pistons and the sleeves is difficult due to such small clearance.

Known attempts to introduce oil directly into the clearance space between the sleeves and the pistons have not been successful. Specifically, the oil supply hole for each cylinder must be located at the outer side of each cylinder due to the location of the exhaust and water passageways. Therefore, the oil supply holes for both banks of cylinders must be located in the outer cylinder walls.

In a v-type engine, and as the crankshaft rotates in a clockwise direction, the pistons in the first cylinder bank are thrust against the inner cylinder walls, and the pistons in the second cylinder bank are thrust against the outer cylinder walls. The second cylinder bank pistons thrust against the outer cylinder walls, and therefore against the oil supply holes in the outer cylinder walls, inhibit oil from being introduced into the cylinder through such holes. As a result, the second cylinder bank may be starved for lubrication.

It would be desirable to provide an oil injection system which injects oil directly between the pistons and the cylinder sleeves in a v-type engine. It also would be desirable to provide such a system which does not add significant costs or complexity to fabrication and assembly of the engine.

BRIEF SUMMARY OF THE INVENTION

These and other objects may be attained by oil injection apparatus and methods for injecting oil directly between the cylinder sleeves and the pistons of both cylinder banks in a v-type engine. In one embodiment, an oil port in the engine block extends to an annular groove in the cylinder wall. An oil pump supplies lubricating oil to the port via a conduit and under the control of a control unit.

In operation, if the piston is thrust into the cylinder wall at the location of the groove when the oil is being injected, the oil flows into the groove and is dispersed as the piston moves past the groove on the next stroke. If the piston is not thrust into the cylinder wall at the time oil is introduced, the oil flows into the cylinder and is dispersed by the piston.

Such direct injection of the oil at a location between the piston and the cylinder wall provides the advantage that lubricating oil is located between the piston and the cylinder in each cylinder. As a result, there is less friction between the pistons and the cylinders as compared to the friction if no lubricant is provided between the pistons and cylinders. Therefore, less heat is generated (i.e., less energy loss) due to such friction, and wear of the pistons and cylinders is reduced.

DETAILED DESCRIPTION OF THE INVENTION

Figure 1:
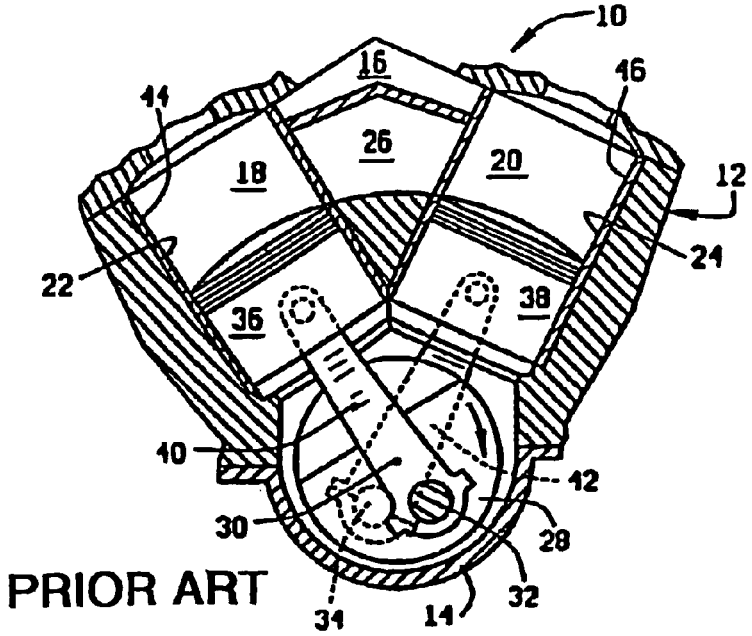
FIG. 1 is a schematic, partial cross-sectional illustration of a known internal combustion engine for marine use.

FIG. 1 is a schematic, partial cross-sectional illustration of a known internal combustion engine 10 for marine use. Engine 10 is shown schematically primarily to describe one known engine configuration. The present invention is not limited to practice in engine 10, and can be used in connection with many other engine arrangements. For example, the present invention can be used in both two stroke and four stroke engines. Further, although the present invention is described herein in connection with a single fluid, pressure surge direct in-cylinder fuel injection system, the invention can be used in connection with many other fuel injection systems including, for example, dual fluid, air-assisted direct in-cylinder fuel injection systems.

Engine 10 includes a cylinder block 12 having a crankcase 14. Cylinder block 12 also includes a main exhaust passageway 16 intermediate first and second cylinders 18 and 20 which extend radially from crankcase 14. Cylinders 18 and 20 include cylinder walls 22 and 24, respectively. Block 12 further includes a water passageway 26 intermediate cylinders 18 and 20.

A crankshaft 28 is supported in crankcase 14 for rotation about a crankshaft axis 30. Angularly spaced first and second crankpins 32 and 34 are coupled to crankshaft 28. Pistons 36 and 38 are connected to crankpins 32 and 34 by connecting rods 40 and 42. Pistons 36 and 38 are reciprocally movable in first and second cylinders 18 and 20 toward and away from crankshaft 28 and between top dead center and bottom dead center positions.

Sleeves 44 and 46 are located in cylinders 22 and 24, and pistons 36 and 38 are in sliding contact with sleeves 44 and 46. The friction between aluminum pistons 36 and 38 and sleeves 44 and 46 can result in generation of heat and wear of both pistons 36 and 38 and sleeves 44 and 46. To reduce such heat generation and wear, oil should be dispersed between pistons 36 and 38 and sleeves 44 and 46. The clearance between pistons 36 and 38 and sleeves 44 and 46, however, is only about 0.004 to 0.010 inches. In addition, lubricating oil is typically introduced into an air stream flowing into crankcase 14 or is dribelled into crankcase 14 at a location that allows crankshaft 28, connecting rod 40 and 42, or pistons 36 and 38 to hit and disperse the oil.

The present invention, in one aspect, provides that oil is injected directly between the cylinder sleeves and the pistons of both cylinder banks in a v-type engine. Particularly, and referring to FIG. 2 which illustrates a portion of a two-stroke internal combustion engine 100, engine 100 includes a cylinder block 102 and a cylinder head 104. Block 102 includes cylinder 106 having piston 108 therein. Although not shown in FIG. 2, a sleeve is located between piston 108 the wall of cylinder 106. Block 102, of course, includes other cylinders and pistons configured the same as cylinder 106 and piston 108. Cylinder 106 includes a combustion chamber 110, and an exhaust manifold 112 communicates with combustion chamber 110.

A crankcase cover 114 forms a sealed crankcase 116, and a crankshaft 118 is supported in crankcase 116 for rotation. A connecting rod 120 extends from crankshaft 118 and is engaged to piston 108. Piston 108 is reciprocally movable toward and away from crankshaft 118 and between top dead center and bottom dead center positions.

A fuel injector 122 communicates directly with combustion chamber 110 and periodically injects fuel unmixed with air directly in chamber 110. A spark plug 124 extends into combustion chamber 110, and is operable to periodically ignite the fuel charges in combustion chamber 110. A control unit 126, which in one embodiment includes an electronic control unit, controls operations of injector 122 and spark plug 124. Additional details regarding the above described engine components are set forth, for example, in U.S. Pat. No. 5,730,099, which is assigned to the present assignee.

In accordance with the present invention, an oil induction port 128 is located at an outer wall 130 of cylinder 106, and port 128 is in flow communication with an annular groove 132, or notch, in cylinder wall 134. Groove 132 extends radially 360 degrees, i.e., is coextensive with wall 134. The sleeve (not shown) includes an annular opening therein that is substantially coextensive with groove 132.

An oil injection circuit 136 supplies oil to port 128. Injection circuit 136 includes an oil pump 138 and an oil distribution manifold 140. An oil supply conduit 142 extends from port 128 to pump 138, and another oil supply conduit 144 extends from pump 138 to manifold 140. Oil pump 138 is coupled to, and controlled by, control unit 126, as is well known in the art.

The particular dimensions of port 128 and groove 132 are selected depending upon the desired amount of oil to be injected during each cycle. The dimensions can be determined empirically. Groove 132 can be machined into block 102, or may be formed when block 102 is fabricated, e.g., during casting operations.

In operation, pump 138 draws oil from manifold 140 and pumps oil through conduit 142 to port 128. If piston 108 is thrust into cylinder wall 134 at the location of port 126 and when oil is being injected, the oil flows into groove 132 and is dispersed as piston 108 moves past groove 132 on the next stroke. If piston 108 is not thrust into cylinder wall 134 at the time oil is introduced, the oil flows into cylinder 106 and is dispersed by piston 108.

Such direct injection of oil at a location between the piston and the cylinder wall provides the advantage that lubricating oil is located between the piston and the cylinder wall in each cylinder. As a result, there is less friction between the pistons and cylinders as compared to the friction if no lubricant is provided between the pistons and cylinders. Therefore, less heat is generated (i.e., less energy loss) due to such friction, and wear of the pistons and cylinders is reduced.

Figure 2:
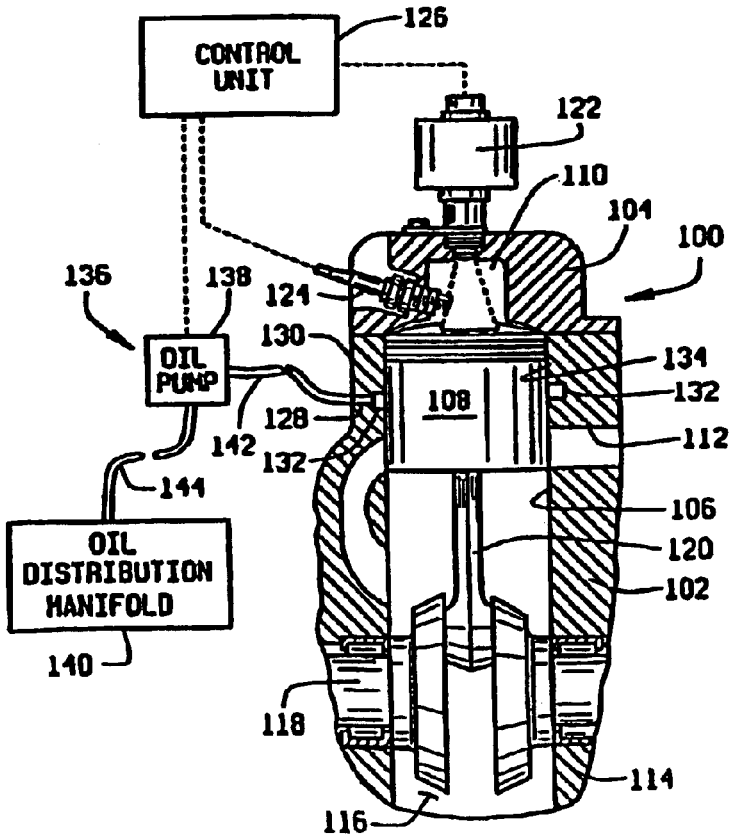
FIG. 2 illustrates a portion of a two-stroke internal combustion engine in accordance with one embodiment of the present invention.
Figure 3:
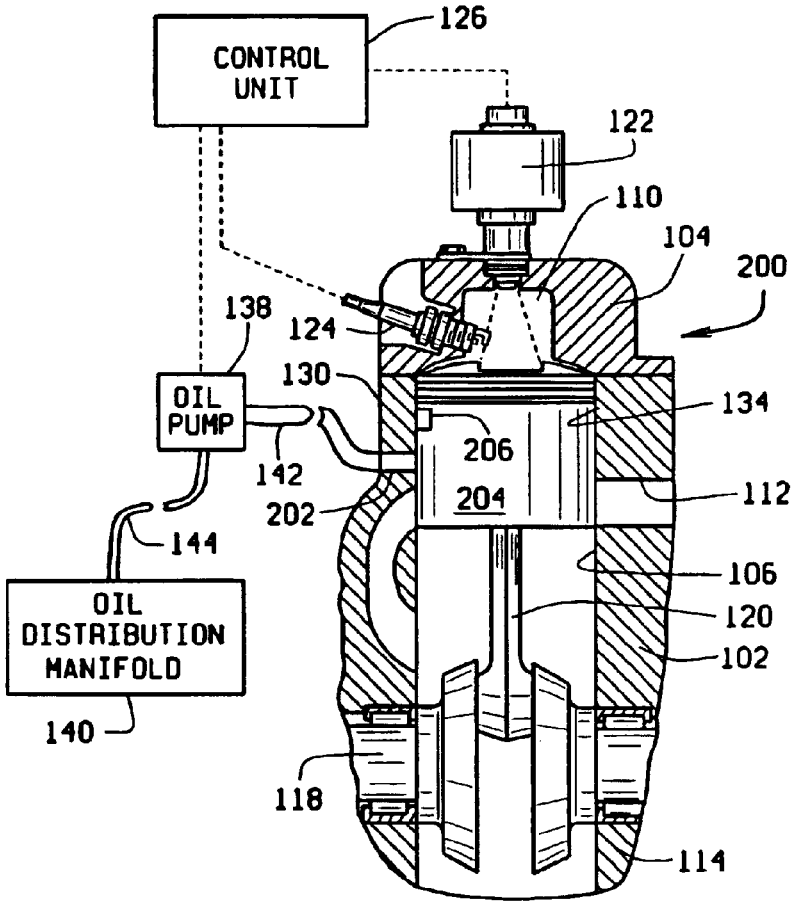
FIG. 3 illustrates a portion of a two-stroke internal combustion engine in accordance with another embodiment of the present invention.

FIG. 3 illustrates another embodiment of an engine 200 in accordance with the present invention. Engine components in FIG. 3 which are identical to the engine components illustrated in FIG. 2 are identified in FIG. 3 using the same reference numerals as used in FIG. 2. In the embodiment shown in FIG. 3, an oil induction port 202 is located at outer wall 130 of cylinder 106. The sleeve (not shown) includes an opening therein that is aligned with port 202. A piston 204 located in cylinder 106 includes an oil flow opening 206 that aligns with port 202 at least for a portion of the movement of piston 204 between top dead center and bottom dead center. In one embodiment, opening 206 aligns with port 202 when piston 204 is at bottom dead center.

The particular dimensions of port 202 and opening 206 are selected depending upon the desired amount of oil to be injected during each cycle. The dimensions can be determined empirically. In addition, opening 206 may be formed in piston 204 by drilling or other machining operations. Alternatively, opening 206 may be formed when piston 204 is fabricated, e.g., during casting operations.

In operation, pump 138 draws oil from manifold 140 and pumps oil through conduit 142 to port 202. If opening 206 in piston 204 is aligned with port 202 when oil is being injected, the oil flows through opening 206, drops onto the piston wrist pin boss, and is dispersed. At least some of the oil will be dispersed against cylinder wall 134 so that lubricating oil is between piston 204 and wall 134. If opening 206 is not aligned with port 202 when oil is being injected, the oil may be prevented from entering into cylinder 106 by piston 204, or some oil may flow between piston 204 and cylinder wall 134.

The above described oil injection systems provide the advantage that oil is dispersed against the cylinder walls of the cylinders in a v-type engine. By providing lubricating oil between the pistons and cylinder walls or sleeves, less friction is generated between the pistons and the sleeves, which facilitates reduced energy loss and wear.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. For example, as explained above, the present invention can be used in both two stroke and four stroke engines, and in connection with single fluid, pressure surge direct in-cylinder fuel injection systems, dual fluid, air-assisted direct in-cylinder fuel injection systems, and other injection systems. Accordingly, the spirit and scope of the invention are to be limited only by the terms of the appended claims.

What is claimed is:

1. A cylinder block for an internal combustion two-cycle engine, said cylinder block comprising a plurality of cylinders having scavenging ports and constructed integral with the cylinder block, at least one of said cylinders comprising a cylinder wall, an oil port arranged to avoid interference with the scavenging ports and to communicate with an interior of the cylinder, and a groove on an interior of said cylinder wail in flow communication with said oil port, the groove extending about a majority of a circumference of the cylinder.

2. A cylinder block In accordance with claim 1 wherein said groove in said cylinder wail is annular.

3. A cylinder block In accordance with claim 1 wherein said groove in said cylinder wall extends 360 degrees.

4. A cylinder block in accordance with claim 1 further comprising a crankcase, a first bank of cylinders, and a second bank of cylinders, said first and second banks of cylinders extending radially from said crankcase.

5. A cylinder block in accordance with claim 4 further comprising a main exhaust passageway and a water passageway intermediate said first and second cylinder banks.

6. An internal combustion two-cycle engine comprising an engine block, said block comprising a crankcase, a crankcase supported in said crankcase, a first bank of cylinders, and a second bank of cylinders, said first and second banks of cylinders extending radially from said crankcase, each of said cylinder banks comprising a plurality of cylinders having scavenging ports for ingress and egress of combustion gases, respective pistons located in each of said cylinders, each of said pistons having a piston ring thereon and coupled to said crankshaft, at least one of said cylinders comprising a cylinder wall, an oil port, one annular groove on an interior of said cylinder wall in flow communication with said oil port, and wherein the oil port is arranged to not interfere with the piston ring and the scavenging port.

7. An internal combustion engine in accordance with claim 6 wherein each said cylinder comprises a combustion chamber, and said engine further comprises at least one fuel injector in direct communication with at least one of said combustion chambers, and a spark plug extending into said at least one combustion chamber.

8. An internal combustion engine in accordance with claim 6 wherein said groove in said cylinder wall extends 360 degrees.

9. An internal combustion engine in accordance with claim 6 further comprising a main exhaust passageway and a water passageway intermediate said first and second cylinder banks.

10. An internal combustion engine in accordance with claim 6 further comprising an oil injection circuit comprising an oil pump, an oil distribution manifold, a first oil supply conduit extending from said port to said pump, and a second oil supply conduit extending from said pump to said manifold.

11. An internal combustion engine comprising:

an engine block having at least one cylinder, the at least one cylinder having a cylinder wall, an oil port in the cylinder wall, a piston, a scavenging port, and a single annular groove on an interior of the cylinder wall in flow communication with the oil port wherein the oil port and the annular groove are arranged to avoid interference with the scavenging port and communicate with an interior of the at least one cylinder.

12. The internal combustion engine of claim 11 wherein the piston has a skirt, the skirt having an opening to allow liquid oil to flow into and through the piston from the oil port through the piston skirt opening.

13. The internal combustion engine of claim 12 wherein the piston skirt opening is configured to be in fluid communication with the groove in the cylinder wall at a predetermined position to provide liquid oil lubrication to the piston skirt and the piston wrist pin boss.

14. The internal combustion engine of claim 12 wherein the piston skirt opening is configured to be in fluid communication with the oil port in the cylinder wall a predetermined position to provide liquid oil lubrication to the piston skirt and the piston wrist pin boss.

15. An engine block comprising:

at least one cylinder, the cylinder having a cylinder wall;

an oil port disposed in the cylinder wall;

a piston having a skirt, the skirt having an opening configured to be in linear communication with the oil port at a predetermined position to provide liquid oil lubrication to the piston skirt and piston wrist boss; and an annular groove disposed on an interior of a cylinder wall configured to be in fluid communication with the oil port and provide liquid oil lubrication to the piston skirt.

16. An internal combustion two-cycle engine comprising an engine block, said block comprising a crankcase, a crankshaft supported in said crankcase, a first bank of cylinders, and a second bank of cylinders, said first and second banks of cylinders extending radially from said crankcase, each of said cylinder banks comprising a plurality of cylinders having scavenging ports for ingress and egress of combustion gases, respective pistons located in each of said cylinders, each of said pistons having a piston ring thereon and coupled to said crankshaft, at least one of said cylinders comprising a cylinder wail, an oil port, one groove extending 360 degrees on an interior of said cylinder wall in flow communication with said oil port, and wherein the oil port is arranged to not interfere with the piston ring and the scavenging port.

17. An internal combustion two-cycle engine comprising an engine block, said block comprising a crankcase, a crankshaft supported in said crankcase, a first bank of cylinders, and a second bank of cylinders, said first and second banks of cylinders extending radially from said crankcase, each of said cylinder banks comprising a plurality of cylinders having scavenging ports for ingress and egress of combustion gases, respective pistons located in each of said cylinders, each of said pistons having a piston ring thereon and coupled to said crankshaft, at least one of said cylinders comprising a cylinder wall, an oil port, one groove on an interior of said cylinder wail in flow communication with said oil port, wherein the oil port is arranged to not interfere with the piston ring and the scavenging port, and an oil injection circuit comprising an oil pump, an oil distribution manifold, a first oil supply conduit extending from said port to said pump, and a second oil supply conduit extending from said pump to said manifold.

* * * * *